US012012259B2

(12) United States Patent
Green et al.

(10) Patent No.: US 12,012,259 B2
(45) Date of Patent: Jun. 18, 2024

(54) CHILD-RESISTANT PACKAGE

(71) Applicant: SMOL LIMITED, Crawley (GB)

(72) Inventors: Nicholas Green, Crawley (GB); Matthew Gandy, Crawley (GB)

(73) Assignee: SMOL LIMITED, Crawley (GB)

( * ) Notice: Subject to any disclaimer, the term of this patent is extended or adjusted under 35 U.S.C. 154(b) by 231 days.

(21) Appl. No.: 17/636,245

(22) PCT Filed: Aug. 10, 2020

(86) PCT No.: PCT/GB2020/051908
§ 371 (c)(1),
(2) Date: Feb. 17, 2022

(87) PCT Pub. No.: WO2021/032949
PCT Pub. Date: Feb. 25, 2021

(65) Prior Publication Data

US 2022/0289425 A1 Sep. 15, 2022

(30) Foreign Application Priority Data

Aug. 19, 2019 (GB) ..... 1911867

(51) Int. Cl.
*B65D 5/38* (2006.01)
*B65D 5/02* (2006.01)

(52) U.S. Cl.
CPC ..... *B65D 5/38* (2013.01); *B65D 5/0254* (2013.01); *B65D 2215/02* (2013.01)

(58) Field of Classification Search
CPC .. B65D 5/38; B65D 2215/02; B65D 2215/00; B65D 5/2057; B65D 5/503; B65D 11/12;
(Continued)

(56) References Cited

U.S. PATENT DOCUMENTS 4,126,224 A 11/1978 Laauwe et al.
4,836,378 A * 6/1989 Lephardt ..... B65D 75/66 229/203

(Continued)

FOREIGN PATENT DOCUMENTS

WO 2015000896 A1 1/2015
WO 2016138305 A1 9/2016
WO 2018190910 A1 10/2018

OTHER PUBLICATIONS

EPO/ISR. PCT/GB2020/051908, PCT Search Report and Written Opinion dated Oct. 14, 2020, Smol Limited (9 pgs).

(Continued)

*Primary Examiner* — Steven A. Reynolds
*Assistant Examiner* — Prince Pal
(74) *Attorney, Agent, or Firm* — Crawford Maunu PLLC

(57) ABSTRACT

The invention provides a child-resistant package (10) comprising an inner tray (100) defining a storage compartment (101) and an outer sleeve (200). The package has a locking system which releasably locks the inner tray (100) in the closed position by means of a locking (tab 150) which releasably engages a locking aperture (213) in the closed position. The package also has a stopping system which prevents further withdrawal of the inner tray (100) from the outer sleeve (200) in the open position by means of the same locking tab (150) engaging a stopping aperture (214) in the open position. The locking tab (150) forms part of both the locking system and the stopping system and the locking tab is involved in both functions.

12 Claims, 6 Drawing Sheets

(58) Field of Classification Search

CPC ..... B65D 2583/0468; B65D 50/046; B65D 2215/04; B65D 5/541; B65D 5/6664; B65D 59/04; B65D 77/0433; B65D 2401/00; A61J 1/035; B31B 2110/35; B31B 2120/60; B31B 50/20; B31B 50/26; Y10S 229/913

USPC ..... 206/1.5, 528; 229/125.125, 120.08, 122, 229/913, 102

See application file for complete search history.

(56) References Cited

U.S. PATENT DOCUMENTS

| | | | | |
|---|---|---|---|---|
| 6,168,073 | B1 * | 1/2001 | Towle | B65D 5/38 229/122 |
| 7,708,142 | B2 * | 5/2010 | Ehrlund | B65D 5/38 206/528 |
| 9,981,788 | B2 * | 5/2018 | Skinner | B65D 5/38 |
| 10,518,927 | B2 * | 12/2019 | Chambers | B65D 5/6664 |
| 11,230,405 | B2 * | 1/2022 | Fahlke | B65D 50/046 |
| 11,365,022 | B2 * | 6/2022 | Altman | B65D 43/20 |
| 2003/0006165 | A1 * | 1/2003 | Evans | B65D 5/0254 206/320 |
| 2007/0181458 | A1 * | 8/2007 | Ehrlund | B65D 5/38 206/528 |
| 2007/0284277 | A1 * | 12/2007 | Gnepper | B65D 11/12 206/528 |
| 2008/0135428 | A1 * | 6/2008 | Tallier | B65D 75/5827 383/207 |
| 2009/0152134 | A1 | 6/2009 | Katsis | |
| 2012/0234701 | A1 * | 9/2012 | Albrecht | B65D 83/0463 206/1.5 |
| 2016/0001937 | A1 * | 1/2016 | Skinner | B65D 5/38 206/1.5 |
| 2016/0152373 | A1 * | 6/2016 | Linssen | B65D 5/38 206/1.5 |
| 2016/0176617 | A1 * | 6/2016 | Bolognia | B65D 5/38 229/120.08 |
| 2016/0251107 | A1 * | 9/2016 | Everett | B65D 5/38 206/1.5 |
| 2017/0036808 | A1 * | 2/2017 | Everett | B65D 5/6664 |
| 2017/0217658 | A1 * | 8/2017 | Whitehurst | B65D 5/38 |
| 2018/0022498 | A1 * | 1/2018 | Everett | B65D 5/2057 220/682 |
| 2018/0072452 | A1 * | 3/2018 | Chambers | B65D 5/10 |
| 2019/0062023 | A1 * | 2/2019 | Lantz | B65D 77/22 |
| 2019/0337689 | A1 * | 11/2019 | Mazurek | B65D 5/503 |
| 2020/0087021 | A1 * | 3/2020 | Tsai | B65D 50/045 |
| 2020/0189813 | A1 * | 6/2020 | Drosos | B65D 83/0463 |
| 2021/0031969 | A1 * | 2/2021 | Fahlke | B65D 50/046 |
| 2021/0171235 | A1 * | 6/2021 | Boland | B65D 5/38 |
| 2021/0276758 | A1 * | 9/2021 | Chen | B31B 50/20 |
| 2022/0204210 | A1 * | 6/2022 | Joines | B65D 5/38 |
| 2023/0016379 | A1 * | 1/2023 | Steinkamp | B65D 5/38 |
| 2023/0142224 | A1 * | 5/2023 | Buck | B65D 5/38 53/492 |
| 2023/0249870 | A1 * | 8/2023 | Huang | B65D 5/38 229/125.125 |

OTHER PUBLICATIONS

EPO/IPRP. PCT/GB2020/051908, PCT International Preliminary Report on Patentability dated Dec. 19, 2019, Smol Limited (9 pgs).

* cited by examiner

CHILD-RESISTANT PACKAGE

TECHNICAL FIELD

The present invention relates to a child-resistant package and in particular to a child-resistant package suitable for delivery of products to consumers by post.

BACKGROUND ART

Certain products, for a variety of obvious reasons, are required to be supplied in child-resistant or child-impeding packaging. Typically, such packaging will be difficult for a child to open because it requires a certain level of strength or dexterity, or a determination of how the package is to be successfully opened which may not be evident to a child.

One specific market where child-resistant packaging is required is the supply of laundry or dishwashing capsules/tablets by post, in order to prevent a child opening the delivered package before an adult has been able to put the package in a safe place. There are many other market channels and products which require child-resistant packaging however, and the invention is not limited to any specific market or product.

Traditionally, for ease of design and manufacturing, child-resistant packaging has been made from plastics. However, environmental concerns regarding the use of plastics is driving suppliers of products and packaging to look at alternative materials, such as card or cardboard, which can be made from recycled material and/or can themselves be recycled. However, there remains a need for the packaging to be child-resistant.

Furthermore, depending on the application, there may be other requirements that the packaging must fulfil. In the supply of laundry or dishwashing capsules/tablets by post, for example, the packaging needs to be robust enough to survive transportation through the postal system intact, and to be sufficiently compact to fit through a standard letterbox. Once with the consumer, the packaging should be capable of being repeatedly opened and closed during its life, as each individual capsule/tablet is used, without the loss of the child-resistant functionality. Each time the packaging is closed, the "locked" child-safe configuration should be automatically adopted. The packaging must also be moisture-proof to prevent water causing the premature breakdown of the water-soluble contents.

In the case of a "drawer"-type package having an inner storage compartment which slides in an outer sleeve between closed and open positions, there may also be a need for a mechanism to prevent the inner storage compartment from being completely withdrawn from the outer sleeve. This can help to prevent accidental spillage of the contents and also means that the two parts of the package remain slidably engaged with one another such that the child-safe configuration can be automatically adopted again after opening.

WO2016/138305 (Everett) and WO2018/190910 (All Packaging Company) disclose types of child-resistant, locking package designs.

SUMMARY OF THE INVENTION

The invention provides a child-resistant package comprising an inner member defining a storage compartment, and an outer sleeve, wherein the inner member is slidably engaged within the outer sleeve and is movable between a closed position in which the storage compartment is closed and an open position in which the inner member projects from the outer sleeve and the storage compartment is accessible, wherein the package further comprises a locking system which releasably locks the inner member in the closed position and a stopping system which prevents further withdrawal of the inner member from the outer sleeve in the open position, and wherein the locking system includes a locking tab which releasably engages a locking aperture in the closed position, and wherein the stopping system includes the locking tab which engages a stopping aperture in the open position.

The apertures may have any suitable configuration. They may be formed by holes through a planar part of the package, e.g. a side, top or bottom wall, or by recesses for example.

The locking tab forms part of both the locking system and the stopping system and the locking tab is involved in both functions. The invention provides a simpler construction than prior art package designs, in which completely separate mechanisms are employed for the locking and stopping functions.

In the locking system, the locking tab releasably engages the locking aperture in the closed position. Preferably, the engagement is automatic so that the inner member is automatically locked when in the closed position. Preferably, the releasing of the engagement requires an action by the consumer. The method of releasable engagement is discussed further below.

In the stopping system, the locking tab engages the stopping aperture in the open position. Preferably, the engagement is automatic when the inner member reaches the open position. Preferably, disengagement is also automatic when the inner member is moved from the open position in the reverse direction. The method of engagement is discussed further below. The stopping system prevents further withdrawal of the inner member from the outer sleeve, beyond the open position. In this position, the inner member is still preferably engaged with and partially inside the outer sleeve, but with the storage compartment accessible.

In a preferred embodiment, the locking tab has an extended position and a retracted position, the locking tab being biased towards the extended position such that, when the inner member is in the closed position, the locking tab adopts the extended position and engages with the locking aperture. The biasing may be provided by any suitable mechanism, structure or configuration. The locking tab may be resiliently biased, resiliently hinged, or provided with a "memory property".

Preferably, the locking tab is provided on the inner member, such as a wall of the inner member, and the locking aperture and stopping aperture are provided on the outer sleeve, such as in a wall of the outer sleeve. In some embodiments however, the components may be the other way round.

In the retracted position, the locking tab is preferably substantially flush with the inner member. In the extended position, the locking tab preferably forms an angle of greater than 0 degrees and less than 90 degrees, preferably greater than 5 degrees and less than 45 degrees, and preferably greater than 10 degrees and less than 30 degrees.

Preferably, the locking tab extends adjacent to the side of the inner member and is hinged on the inner member, such as on the lower edge of the side of the inner member.

The locking tab may be formed (e.g. cut out) from the inner member and folded into position. For example, the locking tab may be cut from the side wall of the inner member, or from the top wall or lid, or from the underside.

In a particularly preferred embodiment, the locking tab is cut out from the underside of the inner member and folded around through an angle of greater than 180 degrees to form an acute angle with the side of the inner member. Preferably, the fold angle is greater than 225 degrees. It has been found that a relatively large fold angle such as this causes material to "bunch" in the acute angle between the locking tab and the side wall of the inner member, which can provide the locking tab with the required resilience in the hinge, also known as memory property.

In preferred embodiments, the locking tab has a specific shape which facilitates engagement with the locking aperture and/or release from the stopping aperture, discussed further below.

The outer sleeve preferably has an inner wall and an outer wall and wherein the locking aperture is provided in the inner wall, such that the locking tab projects through the locking aperture in the closed position, into the space between the inner and outer walls. Preferably the inner and outer walls are side walls.

An access aperture is preferably provided in the outer wall so that the locking tab can be urged inwards to the retracted position and out of engagement with the locking aperture, to unlock the inner member and allow movement towards the open position relative to the outer sleeve. The aperture may be sized to permit the locking tab to be moved by the consumer's finger, for example.

In a particularly preferred embodiment, the access aperture is configured such that the locking tab does not project through the aperture when in the closed/locked position. For example, the access aperture may be smaller than the locking tab in terms of a dimension or an area, or it may be positioned relative to the tab such that projection through the tab is prevented. This is an important feature of the invention, because the tab is protected from accidental damage by remaining within the outer wall, which helps to ensure the locking mechanism functions correctly through the life of the container. A removable cover panel may be provided over the access aperture, which prevents accidental opening during shipping, protects the tab from damage, and also acts as a tamper-evident indicator.

In preferred embodiments, the stopping aperture is provided in a wall of the outer sleeve such that, when the inner member is in the open position, the locking tab adopts an extended position and engages the stopping aperture to prevent further withdrawal of the inner member from the outer sleeve, beyond the open position. The extended position may or may not be the same as when in the closed/locked position (see FIGS. 6 and 11 below). As mentioned above, preferably the engagement is automatic when the inner member reaches the open position and preferably disengagement is also automatic when the inner member is moved from the open position in the reverse direction. As with the locking aperture, the relevant wall may be a side wall of the outer member, and may be an inner side wall such that the locking tab projects through the stopping aperture in the open position, into the space between the inner and outer walls.

The stopping aperture preferably presents a stop edge to the locking tab which prevents further movement beyond the open position. The stop edge may be the outermost edge of the stop aperture relative to the direction of movement of the inner member from the closed position to the open position. An angled surface or ramp may be provided on the inner edge of the stop aperture to automatically urge the locking tab to the retracted position as the inner member is moved from the open position towards the closed position. The ramp makes the slide back motion smoother and works in combination with the tab shape.

As mentioned above, in preferred embodiments the locking tab has a specific shape which facilitates engagement with the locking aperture and/or release from the stopping aperture. The locking tab may be square or rectangular, with the outer edge parallel to the hinge and the side edges perpendicular to the hinge. However, one or both of the side edges may not be perpendicular to the hinge.

Preferably, in order to provide positive engagement with the locking aperture (locking edge) and stopping aperture (stop edge), the outer side edge of the locking tab is substantially perpendicular to the hinge, i.e. substantially perpendicular to the direction of movement of the inner member relative to the outer sleeve. In order to facilitate release of the locking tab from the stopping aperture, the inner side edge of the locking tab preferably has an acute angle relative to the direction of movement of the inner member. The angle is an acute angle so greater than 0 degrees and less than 90 degrees, but preferably between about 45 degrees and 90 degrees or between about 45 degrees and 80 degrees. An angle of about 60 degrees has been found to work well. Overall, a preferred shape for the locking tab is a trapezium, including an acute trapezium or a right trapezium.

In any of the above preferred arrangements, the locking tab is preferably retained in the retracted position by the outer sleeve (e.g. by the side wall or inner side wall) as the inner member moves between the closed and open positions.

The package may comprise one or more locking systems and one or more stopping systems. In a preferred embodiment, two locking systems and two stopping systems are provided, a locking system and a stopping system provided on each side of the package.

The inner member may take any suitable configuration, but preferably the inner member is a tray having an underside and upstanding sides. The inner member may also have a hinged lid which is opened to access the storage compartment.

An engagement aperture may be provided in the outer sleeve to enable the inner member to be pushed relative to the outer sleeve towards the open position. A removable cover panel may be provided over the engagement aperture, which prevents accidental opening during shipping and also acts as a tamper-evident indicator.

The components of the package may be made from any suitable material or materials. However, as discussed above, it is preferable that the components are made from materials including recycled material and/or recyclable material. Preferred materials are card or cardboard.

The inner member may be made from corrugated card or cardboard. The resilient hinge or "fold crease" discussed below may run parallel to or perpendicular to the direction of the corrugations. Preferably, the hinge runs parallel to the direction of the corrugations.

At least in preferred embodiments, the invention generally provides an all carton board, child-impeding moisture-resistant pack comprising an inner tray and an outer sleeve for delivery of products (laundry capsules and other) to consumers via the post.

Key technical features include:

- Locking inner tray and outer sleeve which is completely protected and inaccessible to the consumer until the perforated tabs are removed to reveal the locking mechanism and tray release finger hole(s).
- The locking tabs are protected from damage via a false chamber/wall, this ensures the tabs stay safe and locked when the pack is being stored during its life and critically ensure the tabs are in locked position during postage and on receipt by the customer.

- A locking tab mechanism (naturally sprung via carton board flute crease) on one or multiple sides lock the inner tray in position when aligned with the locking slots of the outer sleeve. When the locking mechanism is released (via applying pressure to the tabs) it allows the tray to slide through the sleeve and open.
- The internal tray mechanism has a unique restriction device that limits the aperture of the tray when opened. This device ensures the tray is locked at the midpoint thereby stopping it from sliding out of the sleeve completely and preventing the contents from spilling out accidentally. This encourages the consumer to close the package and automatically lock it again.
- The internal locking device referenced above is created by the uniquely shaped tabs being locked into a second slot which is met further along the sleeve. The uniqueness of the second slot is that it is locks the tray but it is also uniquely tapered in the reverse position to allow it to easily be pushed back into its locked position.
- The sizes of the outer sleeve and finger hole as specifically sized to all the locking mechanism elements so that it effectively engages the mechanism but does not allow the locking flap to protrude from the pack.
- A protected double layer base tray and over card covers ensure minimum moisture ingress to the product carried within.
- A finger hole/slot (revealed via a perforated tab) which allows the consumer to easily push out the tray simultaneously once the locking tab(s) are pushed into release position.

In preferred embodiments, the amount of packaging materials used overall can be minimised. The size of pack overall can be minimised, which ensures the pack is compact for postage and is also efficient for the consumer from a storage perspective. When made from card or cardboard, label information can be conveniently printed directly onto the pack.

BRIEF DESCRIPTION OF THE DRAWINGS

An embodiment of the invention will now be described by way of example only and with reference to the accompanying drawings, in which.

DETAILED DESCRIPTION OF A PREFERRED EMBODIMENT

Figure 1:
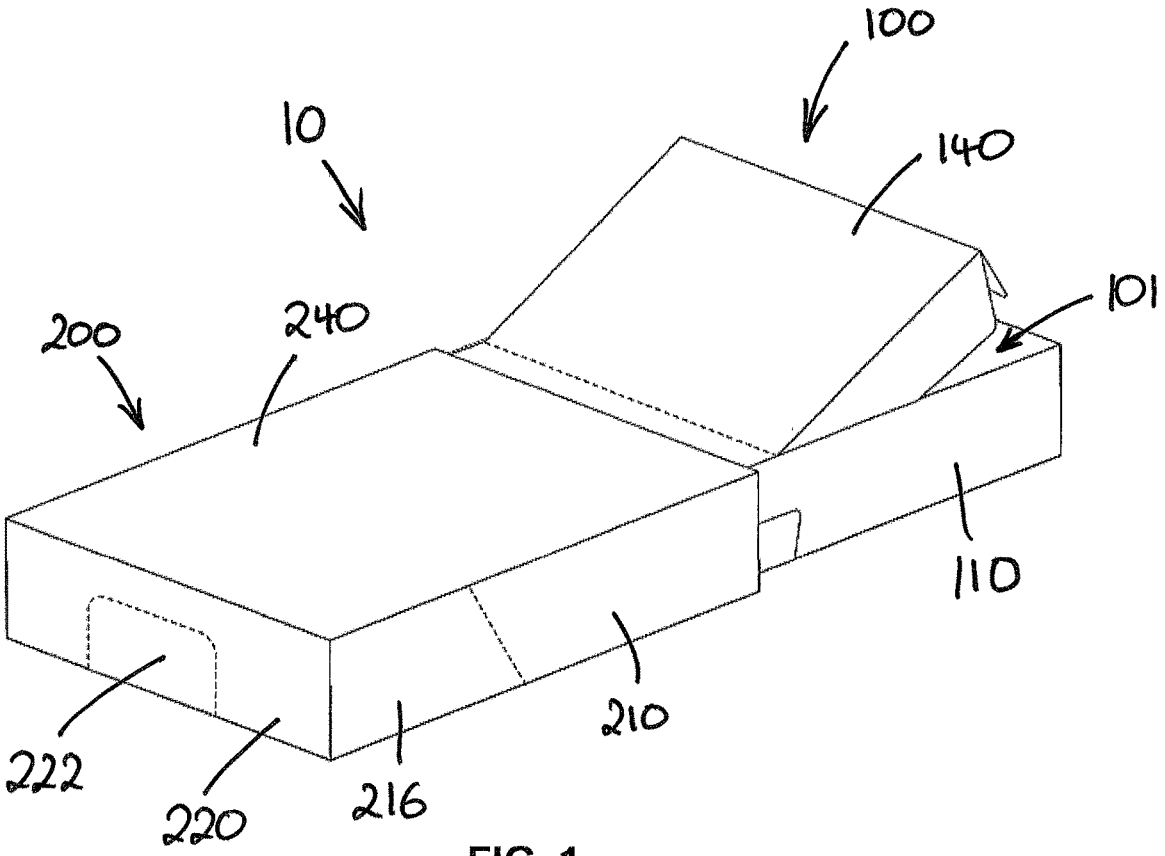
FIG. 1 shows a perspective view of a package in accordance with the invention.
Figure 2:
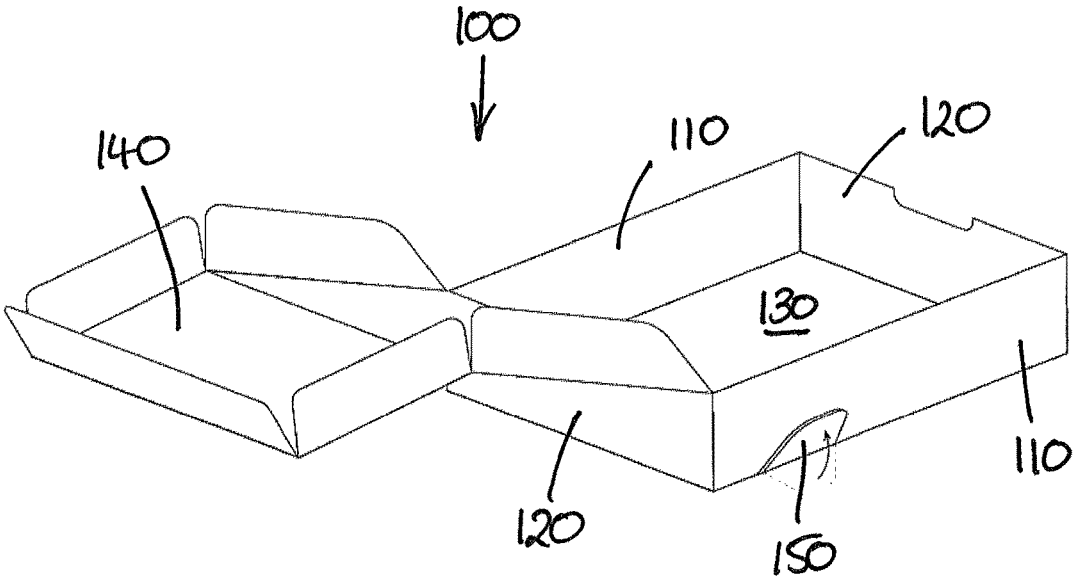
FIG. 2 shows a perspective view of an inner storage tray for use in the package of the invention.

With reference to FIGS. 1 and 2, package 10 has an inner tray 100 which defines a storage compartment 101. Inner tray 100 has side walls 110, end walls 120, bottom wall 130 and a hinged lid 140 which is opened to access the storage compartment 101. Inner tray 100 is slidably engaged with outer sleeve 200.

Outer sleeve 200 has side walls 210, end walls 220 and 221 (only end wall 220 is visible in FIG. 1), bottom wall 230 (not visible in FIG. 1) and top wall 240.

Figure 3:
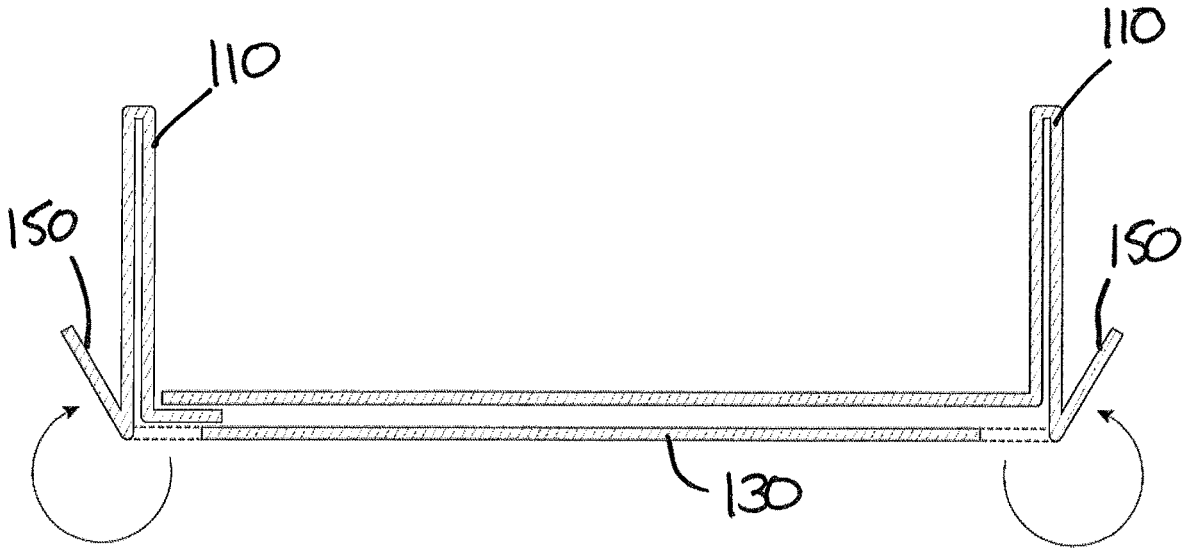
FIG. 3 shows a cross-section through the inner storage tray of FIG. 2.
Figure 4:
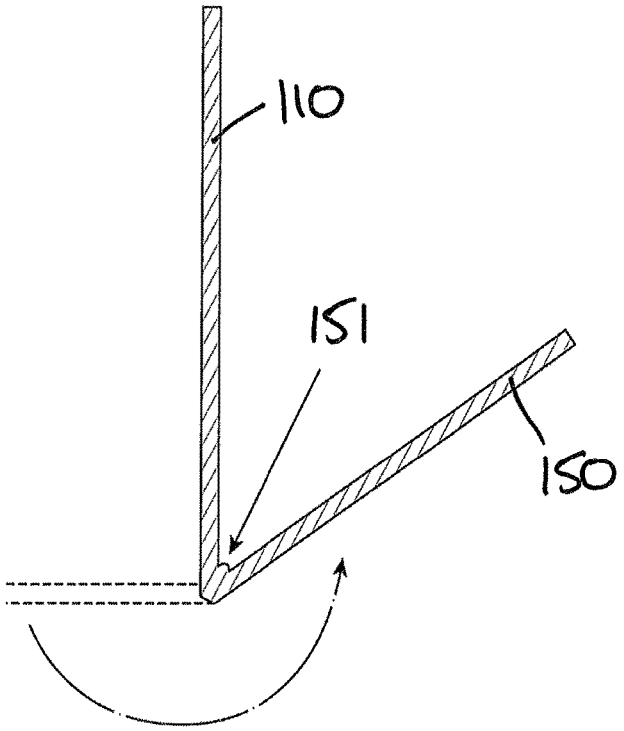
FIG. 4 shows a detailed cross-section through part of the storage tray of FIG. 2.

Locking tabs 150 are an important part of the locking system and the stopping system, and their function will be described below. Referring to FIGS. 3 and 4, the formation of the locking tabs 150 is shown. Each locking tab 150 is cut out from the bottom wall 130 of the inner tray and folded around through an angle of greater than 180 degrees (see arrows) to form an acute angle with the side wall 110 of the inner tray. The resulting "fold crease" 151 provides the resilient hinge mentioned above. The locking tab 150 will have a natural rest position extending away from the side wall 110 (possibly as shown in FIG. 4) but can be urged against the resilient force to a position closer to the side wall 110 and potentially substantially flush with it.

Figure 5:
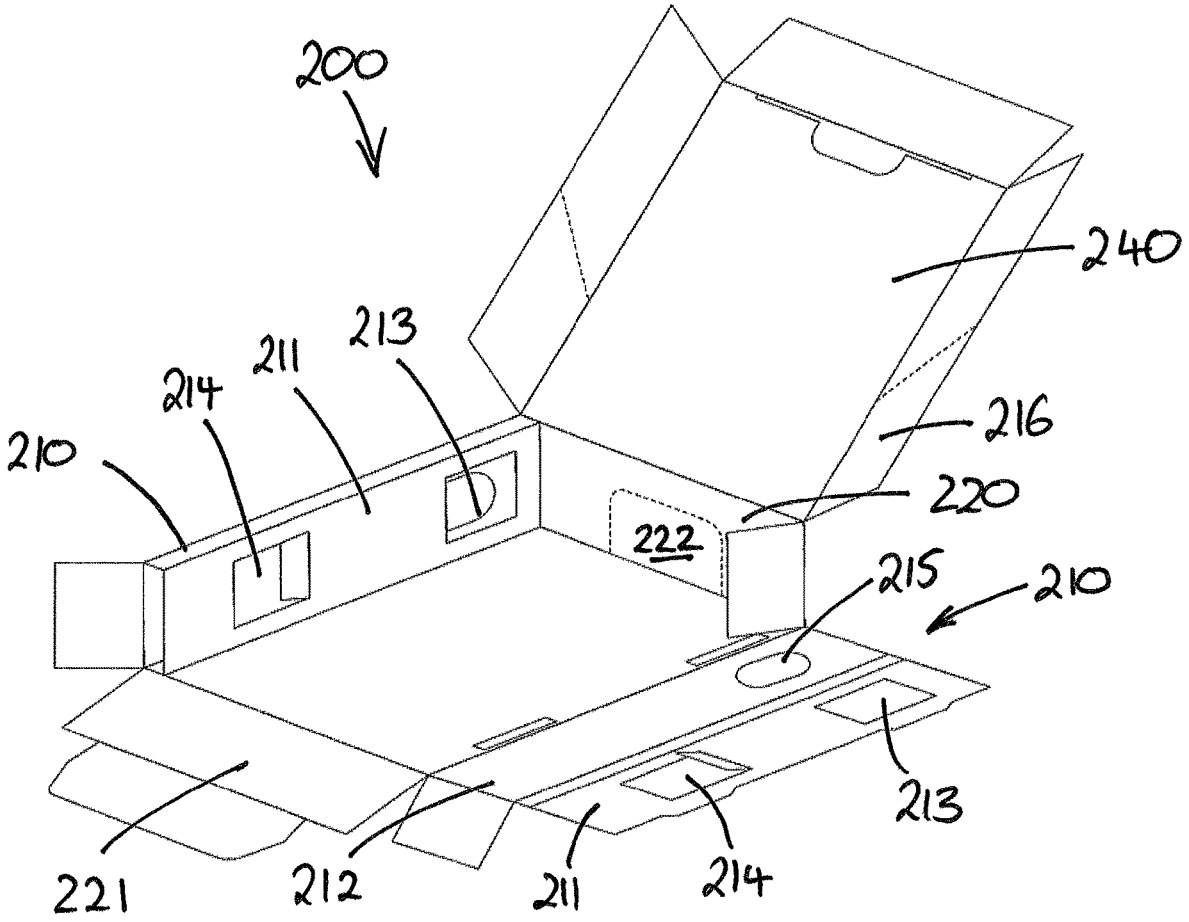
FIG. 5 shows a perspective view of an outer sleeve for use in the package of the invention.

Outer sleeve 200 is shown in more detail in FIG. 5. In this view, the construction of the side walls 210 can been seen in more detail. Side wall 210 is formed from inner side wall 211 and outer side wall 212. Inner side wall 211 has a locking aperture 213 and a stopping aperture 214. Outer side wall 212 has an access aperture 215 which is smaller than locking aperture 213 and prevents locking tab 150 from projecting through the access aperture. Removable cover panels 216 are provided which cover the access apertures 215 (see also FIG. 1).

End wall 220 is provided with a removable panel 222 to create an engagement aperture 223 as will be discussed below. End wall 221 forms a cover flap for closing up the package when inner tray 100 is inside.

Figure 6:
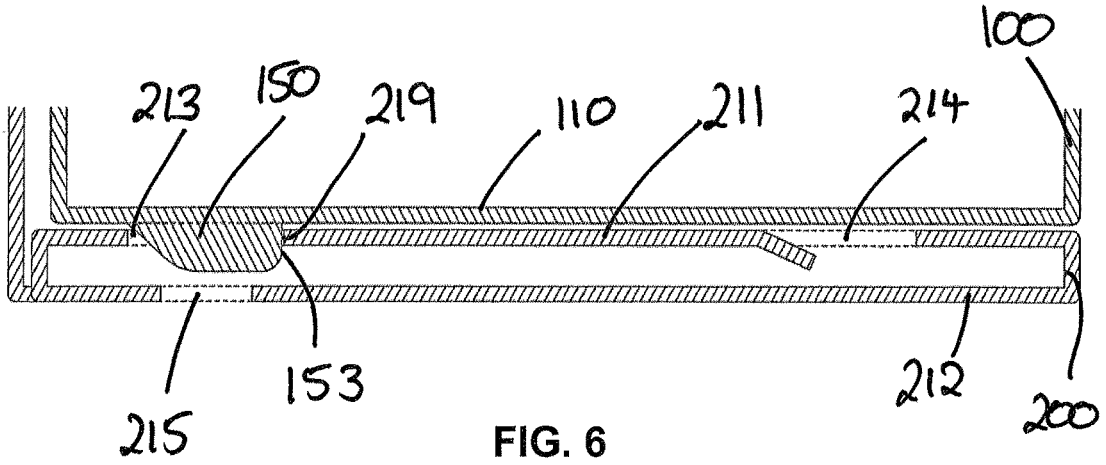
FIG. 6 shows a cross-section through the package of the invention in the closed configuration.

FIG. 6 shows a horizontal cross-section through the side walls 110 and 210 with the inner tray 100 and outer sleeve 200 in the closed, locked configuration. Locking tab 150 is in the extended position and is engaged with locking aperture 213. Specifically, outer side edge 153 of locking tab 150 is engaged with locking edge 219. Inner tray 100 is therefore unable to be removed from outer sleeve 200.

Figure 7:
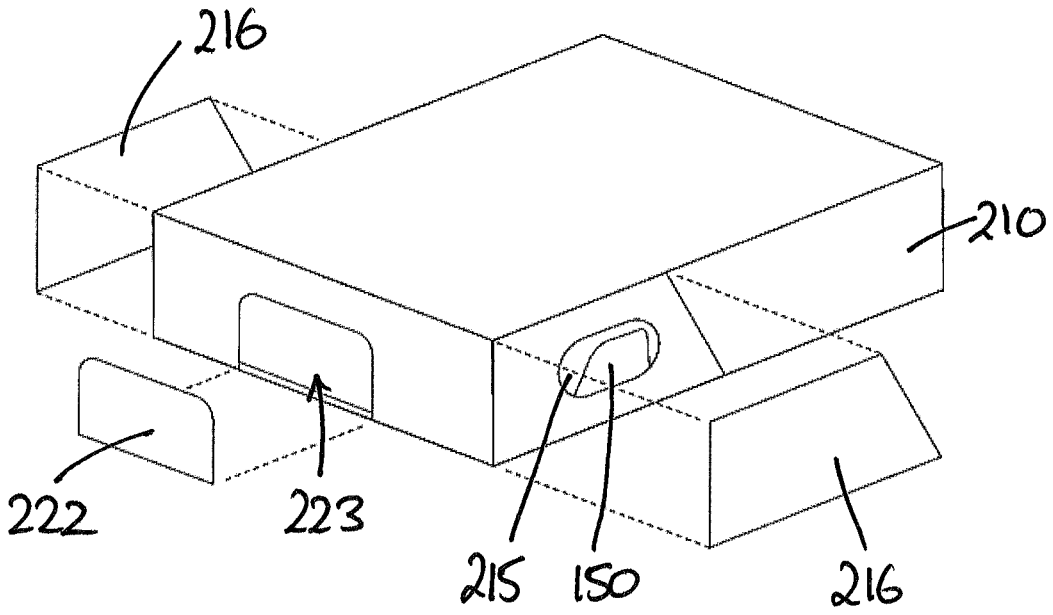
FIG. 7 shows a perspective view of the package of the invention in the closed configuration, with the tamper-proof panels being removed.

With reference to FIG. 7, in order to open the package, cover panels 216 over the access apertures 215 are removed, for example by tearing along a line of weakness or perforation. Panel 222 is also removed to create the engagement aperture 223.

Figure 8:
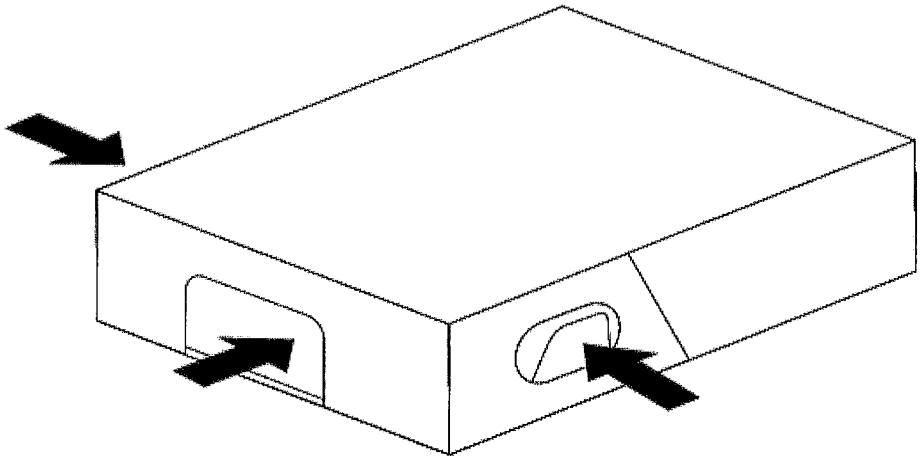
FIG. 8 shows a perspective view of the package of the invention in the closed configuration, showing where forces are applied to open the package.

FIG. 8 shows the forces required for the consumer to move the inner tray 100 out of the outer sleeve 200.

Figure 9:
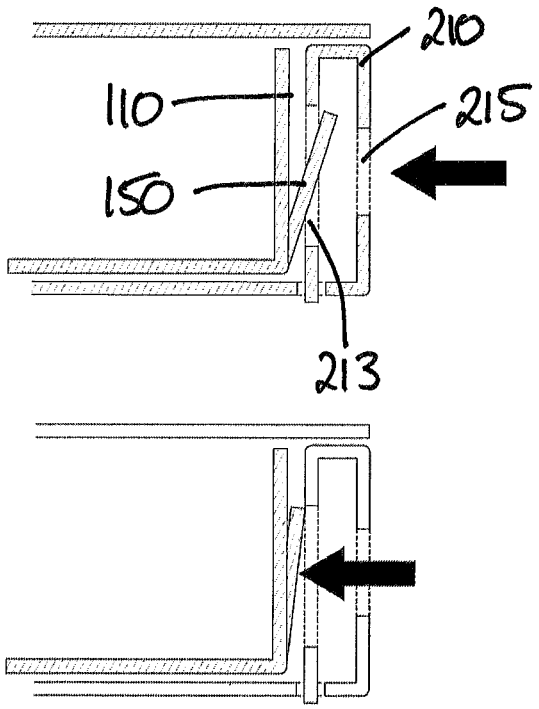
FIG. 9 shows a cross-section of part of the package of FIG. 8.
Figure 10:
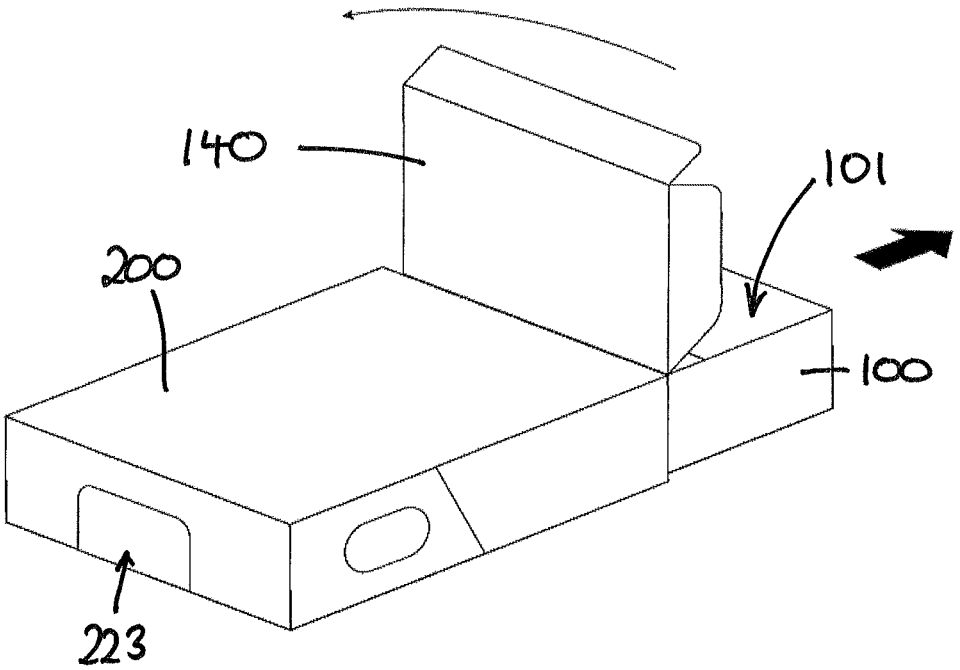
FIG. 10 shows a perspective view of the package of the invention in the open configuration.

FIG. 9 shows a vertical cross-section through the side walls 110 and 210. The upper figure shows locking tab 150 in the extended position, engaged with locking aperture 213. By application of a force shown by the arrow, e.g. by the consumer placing a finger through the access aperture 215, the locking tab 150 can be moved to the retracted position and out of engagement with the locking aperture 213, as shown in the lower figure. The inner tray 100 can then be moved out of the outer sleeve 200 by application of a force applied to the inner tray 100 through engagement aperture 223, as shown in FIG. 10, and moved to the open configuration. Hinged lid 140 can then be opened to access storage compartment 101.

Figure 11:
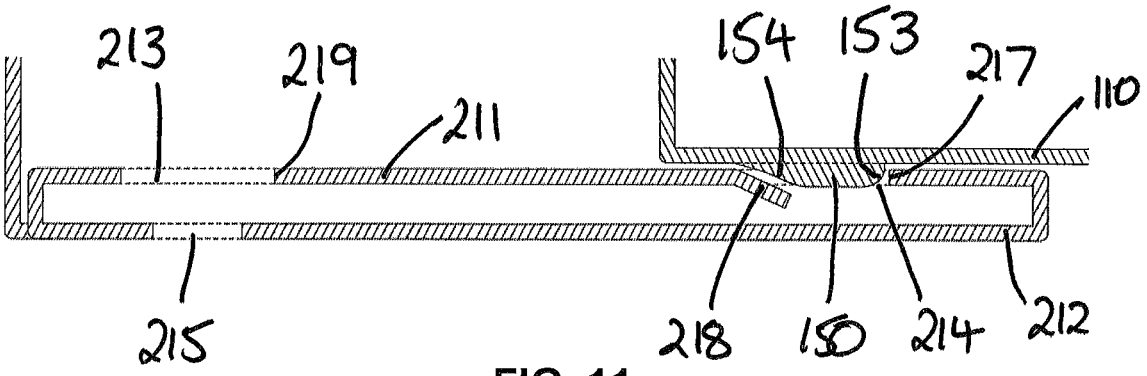
FIG. 11 shows a cross-section through the package of the invention in the open configuration.

FIG. 11 shows a similar view to FIG. 6, but with the inner tray 100 in the open configuration. The features of the stopping system can be seen, which prevents the inner tray 100 from projecting further than a predetermined amount from the outer sleeve 200. As inner tray 100 reaches the open position and locking tab 150 aligns with stopping aperture 214, the tab automatically extends outward to an extended position (which, in this embodiment, as can be seen by comparing with FIG. 6, is not as extended as in the closed, locked configuration). The locking tab 150 is then engaged with stopping aperture 214 and inner tray 100 is prevented from being further withdrawn from outer sleeve 200 by stop edge 217 on the outermost edge of the stop aperture, against which outer side edge 153 of locking tab 150 abuts.

Ramp 218 is provided on the inner edge of the stopping aperture 214 to automatically urge the locking tab 150 to the retracted position as the inner member 100 is pushed in, from the open position towards the closed position. Therefore, no action is required by the consumer to disengage the locking tab from the stopping aperture other than pushing the inner tray back into the outer sleeve. Locking tab 150 is shaped to facilitate this function, and is provided with an inner side edge 154 which is angled relative to the direction of movement of the inner tray 100. In this embodiment, the locking tab shape is a right trapezium.

The invention claimed is:

1. A child-resistant package comprising:

an inner member defining a storage compartment, and an outer sleeve having an inner wall and an outer wall with a space therebetween, wherein the inner member is slidably engaged within the outer sleeve and is movable between a closed position in which the storage compartment is closed and an open position in which the inner member projects from the outer sleeve and the storage compartment is accessible, wherein the package further includes a locking system which releasably locks the inner member in the closed position and a stopping system which prevents further withdrawal of the inner member from the outer sleeve in the open position, and wherein the package further includes a locking tab which releasably engages a locking aperture in the closed position, and which releasably engages a stopping aperture in the open position, wherein the locking tab has an extended position and a retracted position, the locking tab being biased towards the extended position such that, when the inner member is in the closed position, the locking tab adopts the extended position and engages with the locking aperture, wherein the locking tab is provided on the inner member and the locking aperture and stopping aperture are provided in the inner wall of the outer sleeve, such that the locking tab projects through the locking aperture in the closed position, into the space between the inner and outer walls, wherein the locking tab extends adjacent to the side of the inner member, is hinged on the inner member, and is cut out from the underside of the inner member and folded around through an angle of greater than 180 degrees to form an acute angle with the side of the inner member, wherein an access aperture is provided in the outer wall so that the locking tab can be urged inwards to the retracted position and out of engagement with the locking aperture, to unlock the inner member and allow movement towards the open position relative to the outer sleeve, wherein a removable cover is provided over the access aperture, and wherein the access aperture is configured such that the locking tab does not project through the aperture when in the closed position.

2. The child-resistant package of claim 1, wherein the stopping aperture is provided in a wall of the outer sleeve such that, when the inner member is in the open position, the locking tab adopts an extended position and engages the stopping aperture to prevent further withdrawal of the inner member from the outer sleeve, beyond the open position.

3. The child-resistant package of claim 2, wherein the stopping aperture presents a stop edge to the locking tab which prevents further movement beyond the open position.

4. The child-resistant package of claim 3, wherein the stop edge is the outermost edge of the stop aperture relative to the direction of movement of the inner member from the closed position to the open position.

5. A child-resistant package, comprising:

an inner member defining a storage compartment, and an outer sleeve having an inner wall and an outer wall with a space therebetween, wherein the inner member is slidably engaged within the outer sleeve and is movable between a closed position in which the storage compartment is closed and an open position in which the inner member projects from the outer sleeve and the storage compartment is accessible, wherein the package further includes a locking system which releasably locks the inner member in the closed position and a stopping system which prevents further withdrawal of the inner member from the outer sleeve in the open position, and wherein the package further includes a locking tab which releasably engages a locking aperture in the closed position, and which releasably engages a stopping aperture in the open position, wherein the stopping aperture presents a stop edge to the locking tab which prevents further movement beyond the open position and is provided in a wall of the outer sleeve such that, when the inner member is in the open position, the locking tab adopts an extended position and engages the stopping aperture to prevent further withdrawal of the inner member from the outer sleeve, beyond the open position, the stop edge being the outermost edge of the stopping aperture relative to the direction of movement of the inner member from the closed position to the open position wherein the locking tab has an extended position and a retracted position, the locking tab being biased towards the extended position such that, when the inner member is in the closed position, the locking tab adopts the extended position and engages with the locking aperture, wherein the locking tab is provided on the inner member and the locking aperture and stopping aperture are provided in the inner wall of the outer sleeve, such that the locking tab projects through the locking aperture in the closed position, into the space between the inner and outer walls, wherein an access aperture is provided in the outer wall so that the locking tab can be urged inwards to the retracted position and out of engagement with the locking aperture, to unlock the inner member and allow movement towards the open position relative to the outer sleeve, wherein a removable cover is provided over the access aperture, and wherein the access aperture is configured such that the locking tab does not project through the aperture when in the closed position, and wherein a ramp is provided on an inner edge of the stop aperture to automatically urge the locking tab to the retracted position as the inner member is moved from the open position towards the closed position.

6. A child-resistant package, comprising:

an inner member defining a storage compartment, and an outer sleeve having an inner wall and an outer wall with a space therebetween, wherein the inner member is slidably engaged within the outer sleeve and is movable between a closed position in which the storage compartment is closed and an open position in which the inner member projects from the outer sleeve and the storage compartment is accessible, wherein the package further includes two locking systems, in which each locking system releasably locks the inner member in the closed position, and two stopping systems in which each stopping system prevents further withdrawal of the inner member from the outer sleeve in the open position, the locking systems and stopping systems being on opposite sides of the package, and wherein the package further includes a locking tab which releasably engages a locking aperture in the closed position, and which releasably engages a stopping aperture in the open position, wherein the locking tab has an extended position and a retracted position, the locking tab being biased towards the extended position such that, when the inner member is in the closed position, the locking tab adopts the extended position and engages with the locking aperture, wherein the locking tab is provided on the inner member and the locking aperture and stopping aperture are provided in the inner wall of the outer sleeve, such that the locking tab projects through the locking aperture in the closed position, into the space between the inner and outer walls, wherein an access aperture is provided in the outer wall so that the locking tab can be urged inwards to the retracted position and out of engagement with the locking aperture, to unlock the inner member and allow movement towards the open position relative to the outer sleeve, wherein a removable cover is provided over the access aperture, and wherein the access aperture is configured such that the locking tab does not project through the aperture when in the closed position.

7. The child-resistant package of claim 1, wherein the inner member is a tray having an underside and upstanding sides.

8. The child-resistant package of claim 1, wherein the inner member has a hinged lid which is opened to access the storage compartment.

9. The child-resistant package of claim 1, wherein an engagement aperture is provided in the outer sleeve to enable the inner member to be pushed relative to the outer sleeve towards the open position.

10. The child-resistant package of claim 9, further comprising a removable cover provided over the engagement aperture.

11. The child-resistant package of claim 1, wherein an inner side edge of the locking tab has an acute angle relative to the direction of movement of the inner member.

12. The child-resistant package of claim 11, wherein the shape of the locking tab is a trapezium and preferably a right trapezium.

* * * * *